United States Patent [19]

Debruyn, Jr.

[11] Patent Number: 4,756,996

[45] Date of Patent: Jul. 12, 1988

[54] PHOTOGRAPHIC PROCESSING COMPOSITION FOR PROCESSING A PHOTOSENSITIVE ELEMENT OF THE SELF-DEVELOPING TYPE

[75] Inventor: Frank E. Debruyn, Jr., Abington, Mass.

[73] Assignee: Polaroid Corporation, Cambridge, Mass.

[21] Appl. No.: 926,192

[22] Filed: Nov. 3, 1986

[51] Int. Cl.[4] ..... G03C 5/24; G03C 7/26; G03C 1/08

[52] U.S. Cl. ..... 430/486; 430/372; 430/404; 430/455; 430/489; 430/491; 430/493; 430/551

[58] Field of Search ..... 430/455, 551, 372, 404, 430/491, 486, 493, 489

[56] References Cited

U.S. PATENT DOCUMENTS

| | | | |
|---|---|---|---|
| 2,577,127 | 12/1951 | Jennings et al. | 430/372 |
| 3,622,330 | 11/1971 | Valiaveedan | 430/493 X |
| 3,996,054 | 12/1976 | Santemma et al. | 430/493 X |
| 4,267,255 | 5/1981 | Schreiber | 430/486 X |

*Primary Examiner*—Mukund J. Shah
*Attorney, Agent, or Firm*—Philip G. Kiely

[57] ABSTRACT

A photographic processing composition which comprises an aqueous alkaline solution, a silver halide developing agent and a substantially water-insoluble, cationic polyoxyethylene amine containing 2 or 3 mols of ethylene oxide.

7 Claims, No Drawings

PHOTOGRAPHIC PROCESSING COMPOSITION FOR PROCESSING A PHOTOSENSITIVE ELEMENT OF THE SELF-DEVELOPING TYPE

FIELD OF THE INVENTION

The invention relates to photographic processing compositions for use in obtaining positive images of enhanced quality, particularly color transparency images.

BACKGROUND OF THE INVENTION

Copending application of Frank DeBruyn and Lucretia Weed, Ser. No. 828,385 filed Feb. 11, 1986 now U.S. Pat. No. 4,690,884 is directed to a method of exposing a photosensitive element of the self-developing type comprising a photosensitive silver halide emulsion layer, processing the exposed element by the application of an aqueous alkaline photographic processing composition comprising a polymeric thickening agent, by superposing a scavenger-spreader element over the photosensitive element and in contact with the photographic processing composition. A silver halide developing agent and a silver halide solvent may be disposed in the processing composition or in the photosensitive element. The scavenger-spreader element comprises a support carrying a layer of a hydrophilic polymer, a cross-linking agent for the polymeric thickener, a barrier layer to control diffusion of the cross-linking agent and a layer adapted to possess substantial adhesion for cross-linked polymeric thickening agent. In a preferred embodiment, the scavenger-spreader element also includes silver precipitating nuclei. Subsequent to processing, unwanted by-products produced during the processing diffuse to the scavenger-spreader element and the cross-linking agent diffuses into the polymeric thickener. The polymeric thickener exhibits a greater adhesion for the scavenger-spreader element than for the photosensitive element and, upon separation of the scavenger-spreader element from the processed photosensitive element, the unwanted by-products and the excess processing composition would also be removed from the processed photosensitive element leaving the desired negative image.

One of the advantages obtained by the layer removal is a decrease in density in the $D_{min}$ area of the film as a result of the removal of unwanted by-products and residual processing composition. All unwanted materials are not totally removed, however, but the materials remaining are generally insufficient in quantity or in a form that their presence does not substantially effect image quality. High humidity testing of the finished image in the color embodiment, i.e., wherein a dye image is formed, shows an increase in the $D_{min}$ areas which is believed to be caused by the reaction of residual developer which oxidizes and reacts with residual dye coupler to form the dye under the high humidity conditions. The increase in the moisture content of the image element causes residual dye formers, such as coupler, to become mobile thus providing the unwanted color-forming reaction when the coupler contacts residual, relatively immobile developer.

A novel photographic processing composition has now been found for processing a photosensitive element which is not susceptable to the deficiencies of the prior art.

SUMMARY

The present invention is directed to a photographic processing composition for processing an exposed photosensitive element of self-developing type, preferably a color photosensitive element, which comprises an aqueous alkaline solution, a silver halide developing agent and a substantially water-insoluble cationic, polyoxyethylene amine containing 2 or 3 moles of ethylene oxide and to the method of processing the photosensitive element in the presence of the polyoxyethylene amine.

While not intending to be bound by theory it is believed that the polyoxyethylene amine functions in two ways. During processing, while the processing composition is in contact with the photosensitive element, the polyoxyethylene amine enhances the clean-out of the excess unreacted reagents from the photosensitive element. Subsequent to processing, after the processing composition has been removed, insoluble polyoxyethylene amine is retained on the surface of the film unit and functions to render residual dye-former immobile and unreactive under conditions of high humidity.

DETAILED DESCRIPTION OF THE INVENTION

The advantage of the present invention resides in the enhanced stability of the finished color image, particularly with respect to the $D_{min}$ area densities. In the formation of instant positive transparency images, as described in copending application Ser. No. 828,385, unreacted reagents and unwanted by-products are removed from association with the positive image subsequent to processing.

The unwanted by-products of the processing operation and excess unreacted reagents are removed by diffusion to the superposed scavenger-spreader element. For example, in a preferred embodiment, to provide for the removal of undeveloped silver halide, the processing composition includes a silver halide solvent and the scavenger-spreader element includes silver precipitating nuclei to immobilize the diffusing undeveloped silver halide by means of a physical development reaction which also consumes other excess reactants. To further insure the efficient removal of undesirable materials from the thus-formed negative image, the processing composition employs a polymeric thickening material which is cross-linked by a cross-linking agent which diffuses from the scavenger-spreader element. The polymeric thickening agent and the material of the outermost layer of the scavenger-spreader element are selected to provide a greater adhesion for each other than the polymeric thickener would have for the photosensitive element. Upon separation of the two elements, the processing composition preferentially adheres to the scavenger-spreader element. The cross-linking agent converts the processing composition into a rubbery, cohesive layer, providing sufficient strength and integrity so that it doesn't break apart during separation of the elements. Cross-linking may also promote adhesion to the scavenger-spreader layer.

In the embodiment which includes a dye former, such as a diffusible dye-forming coupler, excess coupler and developer would diffuse to the scavenger-spreader layer. However, some developer and coupler would remain in the image element but at generally unobjectionable levels. In addition, a water-soluble quaternary surfactant in the processing composition has been found in the past to control $D_{min}$. As stated above, however, high humidity conditions promoted mobility of the coupler, resulting in contact with residual oxidized developer causing color formation in the $D_{min}$ areas.

By means of the present invention, during processing the removal of excess hydrophobic materials such as developer is enhanced, while subsequent to processing the mobility of the residual coupler under conditions of high humidity is further reduced providing substantial improvement in $D_{min}$ densities.

The photographic composition of the present invention comprises an aqueous alkaline solution, a silver halide developing agent and a substantially water-insoluble cationic polyoxyethylene amine containing 2 or 3 moles of ethylene oxide.

The preferred polyoxyethylene amines employed in the present invention are bis (2-hydroxyethyl) cocoamine (2 moles of ethylene oxide) and N,N',N'-tris (2-hydroxyethyl)-N-tallow-1,3-Diaminopropane (3 mols of ethylene oxide). Because of their water-insolubility properties, the amines form a dispersion in the aqueous processing composition. Upon application of the processing composition to the exposed photosensitive element, some amine is retained on the surface of the element, again due to the water-insoluble nature of the materials while some is dispersed throughout the processing composition. Because of the oil-like hydrophobic interior, the amine is believed to be absorptive to hydrophobic species, thus supplementing or enhancing the action of the scavenger-spreader element. Subsequent to processing, unused coupler in the $D_{min}$ area diffusing to the cationic amine is retained on the surface, associated with the amine, immobilized and unable to contact excess developer and react therewith.

The amine is generally employed in the processing composition at a range of about 0.25% to 3.0% by weight, based on the weight of the processing compositon. Preferably, the amine is employed at a level of about 0.1% by weight based on the weight of the processing composition. Amounts greater than 3.0% may be employed, if desired. However, as the quantity of the amine is increased, the possibility of competition between the color-forming reaction and coupler reacting with the amine increases.

Preferably, the processing composition contains a polymeric thickening agent. The function of the polymeric thickening agent is described in copending application Ser. No. 828,385, which upon cross-linking provides preferential adhesion to the scavenger-spreader element and assists in removing the unwanted products from the processed photosensitive element. Suitable polymeric thickening agents include carboxymethyl cellulose, carboxymethyl hydroxyethyl cellulose, hydroxyethyl cellulose, kappa carrageenan and sodium cellulose sulfate.

The processing composition may also optionally contain silver halide solvents, anti-foggants, preservatives and the like.

Silver halide solvents useful in forming the desired soluble complex with unexposed silver are well known and, for example, may be selected from the alkali metal thiosulfates, particularly sodium or potassium thiosulfates, or the silver halide solvent may be cyclic amide, such as uracil, in combination with a nitrogenous base as taught in U.S. Pat. No. 2,857,274 issued Oct. 21, 1958 to Edwin H. Land, or pseudouracils, such. as the 4,6-dihydroxypyrimidines as taught in U.S. Pat. No. 4,126,459, issued Nov. 21, 1978.

The silver halide developing agents employed in the present invention are of the phenylene diamine type. As examples of suitable developing agents, mention may be made of the following.

N-ethyl-N-(2-methansulfonamidoethyl)-2-methyl-1,4-phenylenediamine (sesquisulfate, monohydrate)

N,N-diethyl-2-methyl-1,4-phenylenediamine (hydrochloride)

N,N-diethyl-1,4-phenylenediamine (hydrochloride)

N-ethyl-N-(2-hydroxyethyl)-1,4phenylenediamine (sulfate, monohydrate)

N,N-diethyl-1,4-phenylenediamine (sulfate)

N-ethyl-N-(2-hydroxyethyl)-2-methyl-1,4-phenylenediamine (sulfate)

EXAMPLE

Photosensitive Element

The photosensitive element was prepared by coating a transparent 4 mil polyester base having a transmission density of about 0.1 with the following layers, in sequence.

1. An antihalation layer comprising 35.0 mg/m$^2$ of a yellow dye, 5.8 mg/m$^2$ of a magenta dye; 268.9 mg/m$^2$ of gelatin; 6.9 mg/m$^2$ of a non-ionic surfactant sold under the tradename OLIN 10G by OLIN Corp., New York, N.Y.

2. a gelatino-silver halide emulsion layer comprising 799 mg/m$^2$ of gelatin, 384 mg/m$^2$ of 0.75 micrometer (0.11 coefficient of variation) ortho sensitized silver bromide grains, 192 mg/m$^2$ of carboxylated styrene/-butadiene copolymer latex and 7.8 mg/m$^2$ of polyvinyl hydrogen phthalate;

3. a coupler layer comprising 864 mg/m$^2$ of tricresyl phosphate, 1483 mg/m$^2$ of gelatin, 754 mg/m$^2$ of 4-chloro-1-naphthol (blue coupler), 399 mg/m$^2$ of primitive silver bromide (0.17 micrometer), 62.8 mg/m$^2$ isopropylnaphthalene sulfonic acid, sodium salt, 37.5 mg/m$^2$ of p-nitrophenylacetonitrile (magenta coupler) and 11.3 mg/m$^2$ of polyvinyl hydrogen phthalate;

4. an anti-abrasion layer comprising 800 mg/m$^2$ of gelatin, 1.3 mg/m$^2$ of fluorinated alkyl carboxylic acid wetting agent sold under the tradename FC129 by 3M Company, St. Paul, Minn., 17 mg/m$^2$ of polyvinyl hydrogen phthalate, 10.8 mg/m$^2$ of silica microspheres (1–5 micrometers), and 6.7 mg/m$^2$ of 4-chloro-3,5-dimethylphenol;

5. an overcoat layer comprising about 161.4 mg/m$^2$ of succindialdehyde and about 17.4 mg/m$^2$ of fluorinated alkyl carboxylic acid wetting agent sold under the tradename FC129 by 3M Company, St. Paul, Minn.

Scavenger-spreader Element

The scavenger-spreader element was prepared by coating a 4 mil polyester base with the following layers, in sequence:

1. a polymeric acid layer comprising a 4/1/5 emulsion terpolymer of methacrylic acid, acrylic acid and butyl acrylate coated at a coverage of about 16,140 mg/m$^2$;

2. a timing layer comprising a 40/40/18/2 tetrapolymer of butyl acrylate/diacetone acrylamide/carbomethoxymethyl acryate/acrylic acid coated at a coverage of about 2000 mg/m$^2$;

3. a layer comprising about 10,760 mg/m$^2$ of gelatin, 1076 mg/m$^2$ of lead acetate and about 1076 mg/m$^2$ of zinc acetate;

4. an outermost layer comprising 430 mg/m$^2$ of propylene glycol alginate and palladium nuclei at a coverage of about 2.8 mg/m$^2$ of palladium.

| Processing Composition A | Weight percent |
|---|---|
| Water | 82.71 |
| Carboxymethyl cellulose N-101 | 4.1 |
| Lithium hydroxide N-80 | 7.4 |
| Sodium sulfite A | 1.05 |
| Sodium thiosulfate B | 1.73 |
| Benzotriazole D-6 | 0.13 |
| 4-hydroxymethyl-4-methyl-1-phenyl-3-pyrazolidone E-21 | 0.18 |
| N—ethyl-N—(2-hydroxyethyl 2-methyl-1,4-phenylenediamine sulfate CD-32 | 0.54 |
| N—ethyl-N—(2-methanesulfonamidoethyl)-2-methyl-1,4-phenylenediamine (sesquisulfate, monohydrate) | 2.16 |

The photosensitive element was exposed at 104 mcs to a xenon flash. The Processing Composition was coated on the Scavenger-Spreader element at a coverage of about 46.3 g/m$^2$ which was then laminated in the dark to the exposed Photosensitive Element. After 4 min. the Scavenger-Spreader Element was stripped from the Photosensitive Element. Densities were measured on the thus-obtained transparency image obtained by reading the neutral column to red, green and blue light in an automatically recording densitometer.

The stability of transparency images at 93% relative humidity and 20° C. was obtained with a variety of processing compositions. The following table shows the changes in densities, particularly $D_{min}$ of images formed using the above-described processing composition, the above-described processing composition containing a water-soluble quaternary ammonium salt and the above-described processing composition containing the polyoxyethylene amine of the present invention.

| | Initial $D_{max}/D_{min}$ | 1 Day $\Delta D_{max}/\Delta D_{min}$ | 5 Day $D_{max}/\Delta D_{min}$ | 3 Day $\Delta D_{max}/\Delta D_{min}$ |
|---|---|---|---|---|
| Processing Composition A (Control 4299) | | | | |
| Red | 2.74/0.30 | 0.16/0.15 | 0.10/0.17 | |
| Green | 2.20/0.31 | 0.10/0.09 | 0.10/0.11 | |
| Blue | 0.85/0.24 | 0.05/0.04 | 0.08/0.06 | |
| Processing Composition A + 1.0% by weight of trimethyl dodecyl ammonium chloride 4302 | | | | |
| Red | 2.69/0.24 | 0.12/0.17 | 0.05/0.20 | |
| Green | 2.13/0.25 | 0.06/0.11 | 0.08/0.13 | |
| Blue | 0.83/0.22 | 0.04/0.03 | 0.07/0.07 | |
| Processing Composition A + 1.0% by weight of bis(2-hydroxyethyl) cocoamine 4300 | | | | |
| Red | 2.67/0.22 | 0.12/0.05 | 0.06/0.10 | |
| Green | 2.18/0.24 | 0.07/0.04 | 0.08/0.07 | |
| Blue | 0.84/0.21 | 0.03/0.00 | 0.06/0.03 | |
| Processing Composition A + 1.0% by weight of N,N',N—tris (2-hydroxyethyl)-N—tallow-1,3-diaminopropane | | | | |
| Red | 2.83/0.26 | | | 0.06/0.03 |
| Green | 2.19/0.31 | | | 0.09/0.02 |
| Blue | 0.80/0.24 | | | 0.06/0.01 |

From the foregoing it will be seen that an improvement in minimizing density change is achieved employing the polyoxyethylene amine. This reflects a minimal increase in dye density caused by residual coupler reaction.

The polyoxyethylene amines useful in the present invention are commercially available. For example bis(2-hydroxyethyl) cocoamine is sold under the tradename ETHOMEEN C/12 and N,N',N'-tris(2-hydroxyethyl)-N-tallow-1,3-diaminopropane is sold under the tradename ETHODUOMEEN T-13 by AKZO Chemie America, Chicago, Ill.

The supports employed in the present invention are not critical. The support or film base employed may comprise any of the various types of rigid or flexible supports. For example, glass, polymeric films of both the synthetic type and those derived from natural occurring products, including paper, may be employed. Preferably, a transparent support is employed. Especially suitable materials comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate propionate; polycarbonates; polystyrenes and the like.

What is claimed is:

1. A photographic processing composition which comprises an aqueous alkaline solution, a silver halide developing agent and a substantially water-insoluble, cationic polyoxyethylene amine containing 2 or 3 moles of ethylene oxide.

2. The composition of claim 1 which includes a polymeric thickening agent.

3. The composition of claim 1 wherein said polyoxyethylene amine is bis(2-hydroxyethylene) cocoamine.

4. The composition of claim 1 wherein said polyoxyethylene amine is N,N',N'-tris (2-hydroxyethyl)-N-tallow-1,3-diaminopropane.

5. The composition of claim 1 wherein said polyoxyethylene amine is present at a range of about 0.25 to about 3.0% by weight, based on the weight of the processing composition.

6. The composition of claim 1 wherein said developing agent is a phenylenediamine.

7. An aqueous photographic processing composition which includes lithium hydroxide, a phenylenediamine silver halide developing agent, a polymeric thickening agent, and a substantially water-insoluble, cationic polyoxyethylene amine containing 2 or 3 moles of ethylene oxide.

* * * * *